United States Patent [19]

Lutters

[11] 4,086,868

[45] May 2, 1978

[54] OAR LOCK ATTACHMENT

[76] Inventor: Samuel F. Lutters, 167 Pinewood Trail, Trumbull, Conn. 06611

[21] Appl. No.: 767,154

[22] Filed: Feb. 9, 1977

[51] Int. Cl.[2] ..... B63H 16/06

[52] U.S. Cl. ..... 115/24.4; 9/1.7; 115/24.5

[58] Field of Search ..... 115/24.4, 24.5, 24.6, 115/24.1; 9/1.7, 1.6; 248/221.3, 222.1, 225.3, 226.5

[56] References Cited

U.S. PATENT DOCUMENTS

| | | | |
|---|---|---|---|
| 1,061,783 | 5/1913 | Shears | 115/24.5 |
| 2,461,256 | 2/1949 | Black | 115/24.4 |
| 2,550,625 | 4/1951 | Vick | 115/24.4 |
| 2,869,812 | 1/1959 | Hamel | 9/1.7 |

*Primary Examiner*—Trygve M. Blix
*Assistant Examiner*—Stuart M. Goldstein
*Attorney, Agent, or Firm*—Bacon & Thomas

[57] ABSTRACT

A removable attachment for small boats having generally flat gunwales for clamping oarlock sockets to the boat, at a convenient height. Threaded tensioning members serve to hold hooked ends of the attachment securely engaged with inner and outer edges of the gunwale.

7 Claims, 4 Drawing Figures

OAR LOCK ATTACHMENT

BACKGROUND OF THE INVENTION

This invention is in the field of attachments for small boats for supporting oarlocks thereon.

Proposals have been made heretofore for mounting oarlocks on small boats having upstanding flange-like edges wherein the attachment was clamped to the upstanding edge. However, small boats are now being manufactured without any upstanding gunwales or flanges or the like and thus are not susceptible to having the prior oarlock attachments fixed thereto.

SUMMARY OF THE INVENTION

This invention comprises generally a removable attachment for a boat having a substantially flat gunwale of appreciable width and comprises a band, the ends of which engage the inner and outer edges of the gunwale and wherein an elevating mechanism presses an intermediate portion of the band upwardly to secure the same in place and is provided with socket means to receive an oarlock at a convenient height.

DESCRIPTION OF A PREFERRED EMBODIMENT

Figure 1:
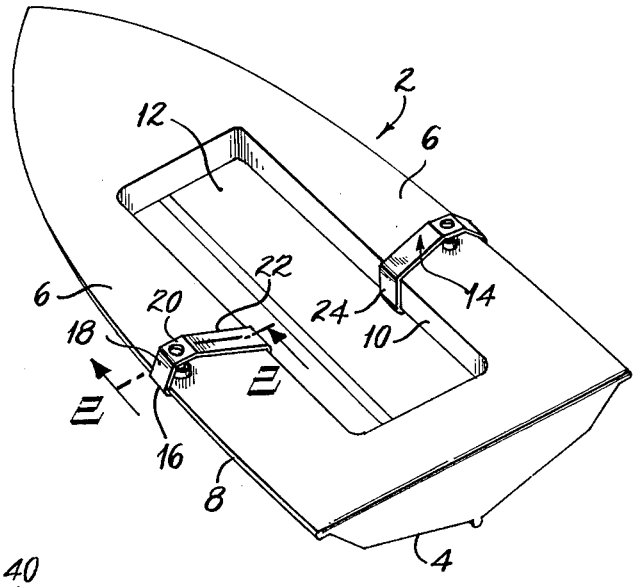
FIG. 1 is a perspective view showing a small boat having a pair of the attachments of the present invention secured thereon.
Figure 2:
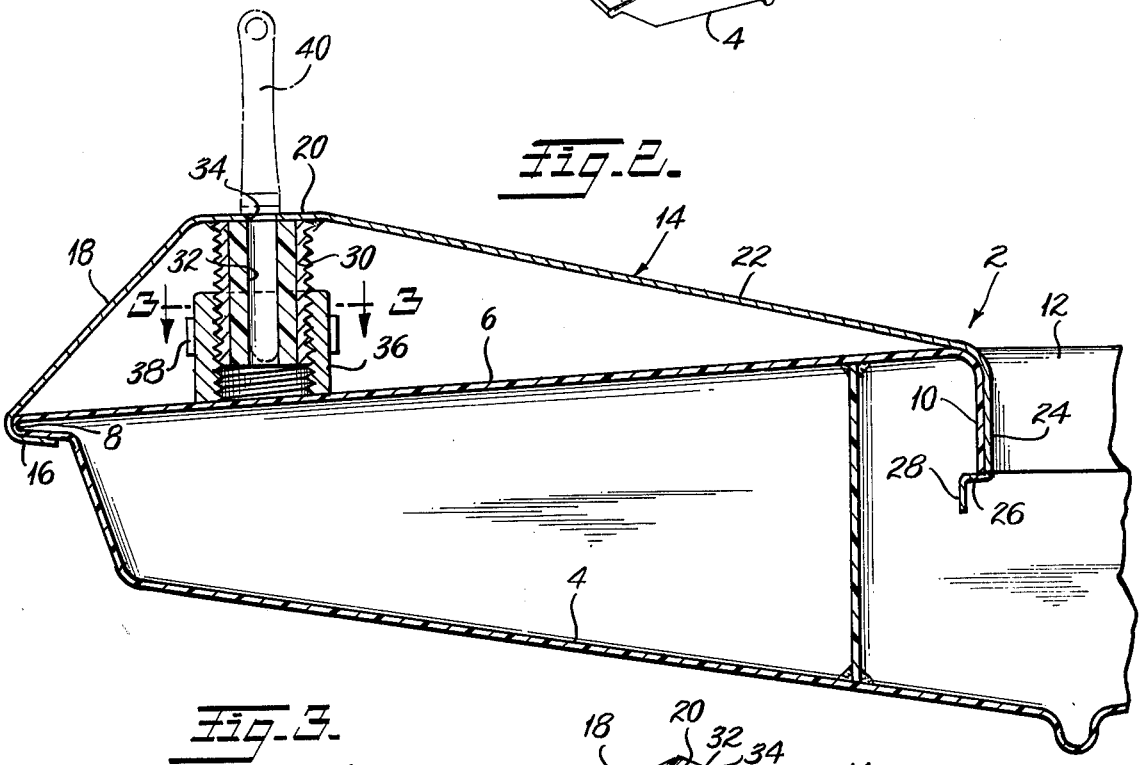
FIG. 2 is an enlarged fragmentary sectional view taken on the line 2—2 of FIG. 1.
Figure 3:
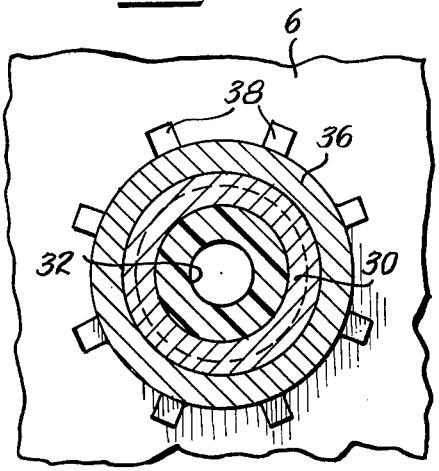
FIG. 3 is a further enlarged sectional view taken on the line 3—3 of FIG. 2.
Figure 4:
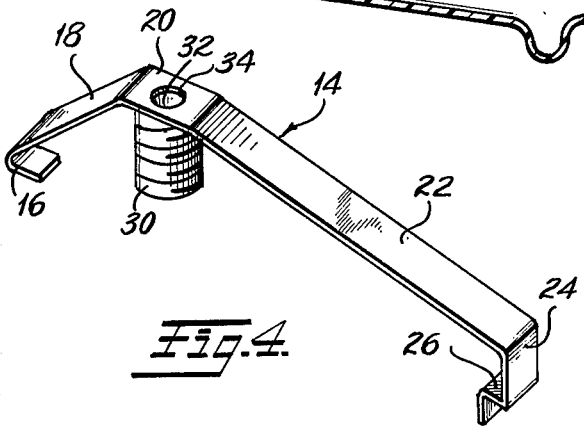
FIG. 4 is a perspective view of the main body portion of the attachment.

In the drawings, numeral 2 designates generally a small boat which may be of the type known as the Sunfish, manufactured by the AMF Company. However, it will be obvious that the invention is adaptable to other small boats.

As shown, the boat 2 comprises a thin-walled, hollow hull 4 having a flat gunwale 6 of substantial width, terminating at its outer edge in a peripheral rib 8 and terminating at its inner edge in a downwardly extending flange 10 defining the periphery of a cockpit 12. While boats of this type are intended for use with a mast and sail, the latter are omitted from the drawings for clarity of illustration. Such boats are usually of such shallow depth that a person in the cockpit desiring to row the boat with oars finds that the gunwale is too low to provide a proper and convenient mounting for oarlocks. The attachment of the present invention comprises a strap 14 of a length substantially greater than the width of the gunwale 6 and which is bent at its outer end to define a hook portion 16 and an upwardly sloping portion 18. At the upper end of the portion 18 there is provided a generally horizontal portion 20 from which a downwardly sloping portion 22 extends to the edge of the cockpit 12 and which is bent downwardly at 24 and inwardly at 26 to define an inner hook portion. A terminal flange 28 is provided to facilitate manual manipulation of the attachment. As shown, the strap 14 is made of metal but it is to be understood that it may be made of other suitable materials such as fiberglas laminate or plastic sheet.

Fixedly secured to the under surface of the portion 20 is an externally threaded body 30 having an upwardly open socket 32 therein aligned with an opening 34 through the portion 20. Threadedly engaged with the external threads of the member 30 is a cylindrical member 36 having internal threads mating with those on the body 30. The exterior of the member 36 is provided with a plurality of circumferentially spaced projections or protuberances 38 to facilitate secure manual grasping of the member 36 and rotating the same.

To apply the attachment thus described, the body 36 is screwed upwardly on the body 30, thus leaving the strap 14 sufficiently flexible to engage its hook 16 over rib 8 and snap its flange 26 onto the lower edge of the flange 10. Thereafter, the body 36 may be grasped and caused to be threadedly advanced downwardly, thus thrusting body 30 upwardly and applying sufficient tension to the strap 14 to securely hold the same in position on the boat. When the device is thus secured to the boat, the socket 32 may receive an oarlock 40 of the usual type and serves to position the same at a convenient selected location on the boat and at a height convenient to a person occupying cockpit 12.

Obviously, the procedures described above may be reversed for removing the attachment from the boat and it will be seen that when the strap 14 is loosened, its flange 28 may be grasped to facilitate disengaging the inner end of the attachment from the edge of the cockpit 12.

While a single specific embodiment of the invention has been shown and described herein, the same is merely illustrative of the principles involved and it is contemplated that the claims appended hereto encompass other embodiments.

I claim:

1. An oarlock mounting device for a boat having a gunwale with inner and outer edges, comprising:

an elongated clamp member having hook-like means at its ends for engagement with corresponding shaped edges of a gunwale;

extensible means on said clamp member extending downwardly therefrom between said hook-like means for engagement with the upper surface of a gunwale between said edges and having a portion movable downwardly relative to said clamp member to tension said clamp member and hold said hook-like means against said edges; and socket means on said device for receiving an oarlock.

2. A device as defined in claim 1 wherein said clamp member is a resilient strap, the ends thereof being bent to define said hook-like means.

3. A device as defined in claim 2 wherein said extensible means comprises an externally threaded member secured to said strap and an internally threaded member threaded thereon and engageable with said gunwale to tension said strap and thereby hold said hook-like means against said edges.

4. A device as defined in claim 3 wherein said socket means comprises an opening through said strap and into said externally threaded member.

5. A device as defined in claim 3 wherein said internally threaded member is provided with circumferentially spaced protuberances to facilitate manual turning thereof.

6. In combination, a boat having a gunwale defining an upwardly facing surface and having inner and outer edges;

a resilient strap member having an intermediate portion sapced above said surface and end portions extending obliquely downwardly from said intermediate portion and having ends formed to define hooks engaging said inner and outer edges, respectively;

selectively extensible means extending downwardly from said intermediate portion to said surface and having a portion movable downwardly relative to said strap for holding said strap member in tension; and means at said intermediate portion defining an upwardly open socket for an oarlock.

7. The combination of claim 6 wherein said extensible means comprises inner and outer threadedly engaged members, the outer member having circumferentially spaced protuberances to facilitate manual turning thereof.

* * * * *